United States Patent [19]

Bianchi et al.

[11] 4,188,920

[45] Feb. 19, 1980

[54] METHOD AND APPARATUS FOR CONTROLLING THE OPERATION OF AN INTERNAL COMBUSTION ENGINE

[75] Inventors: Valerio Bianchi, Hochdorf; Reinhard Latsch, Vaihingen, both of Fed. Rep. of Germany

[73] Assignee: Robert Bosch GmbH, Stuttgart, Fed. Rep. of Germany

[21] Appl. No.: 813,053

[22] Filed: Jul. 5, 1977

Related U.S. Application Data

[63] Continuation of Ser. No. 597,383, Jul. 18, 1975, abandoned, which is a continuation-in-part of Ser. No. 564,073, Apr. 1, 1975.

[30] Foreign Application Priority Data

Jul. 19, 1974 [DE] Fed. Rep. of Germany ..... 2434742

[51] Int. Cl.[2] ..... F02B 3/00

[52] U.S. Cl. ..... 123/32 EA

[58] Field of Search ..... 123/32 EA, 117 R

[56] References Cited

U.S. PATENT DOCUMENTS

| | | | |
|---|---|---|---|
| 2,363,611 | 11/1944 | Newell | 73/517 A |
| 2,403,952 | 7/1946 | Ruge | 73/517 A |
| 2,655,036 | 10/1953 | Chapman | 73/70.1 |
| 2,871,693 | 2/1959 | Navratil | 73/70.1 |
| 3,508,254 | 4/1970 | Ross | 73/517 B |
| 3,596,643 | 8/1971 | Schweitzer | 123/117 R |
| 3,789,816 | 2/1974 | Taplin | 123/32 EA |
| 3,872,846 | 3/1975 | Taplin | 123/32 EA |

*Primary Examiner*—Ronald B. Cox
*Attorney, Agent, or Firm*—Edwin E. Greigg

[57] ABSTRACT

The fluctuations of the rotational speed of the engine crankshaft are detected by two torsionally coupled inertial discs with fiducial markers. The movement of these markers past an inductive sensor provides a signal which is fed to a logical control circuit that controls the generation of a voltage which is characteristic of the actual crankshaft fluctuations. This actual voltage is amplified and rectified and compared with a set-point voltage generated by a set-point generator. The resulting signal is used to control an integrating circuit which may engage the fuel injection system of the exhaust gas recycling system of the engine to change the fuel-air mixture so as to return the actual voltage value to the set-point value.

10 Claims, 7 Drawing Figures

METHOD AND APPARATUS FOR CONTROLLING THE OPERATION OF AN INTERNAL COMBUSTION ENGINE

This is a continuation of application Ser. No. 597,383 now abandoned, filed Jul. 18, 1975 which, in turn, is a continuation-in-part application of application Ser. No. 564,073, filed Apr. 1, 1975.

BACKGROUND OF THE INVENTION

The invention relates to a method for controlling the operation of an internal combustion engine within a predetermined operational domain. This method specifies that the fuel-air ratio of the mixture provided to the internal combustion engine and/or the quantity of recycled exhaust gas in the internal combustion engine is altered in dependence on the magnitude of the scattering of the values of the cyclic variations in the average combustion chamber pressure as measured during time intervals which are in synchronism with the engine rpm.

Due to the increasingly rigorous regulations concerning exhaust gas composition and in view of the general fuel shortage, there is a need for methods and means for operating internal combustion engines in a domain wherein the toxic components of the exhaust gas can be reduced to a minimum and/or in which a minimum amount of fuel is used.

The most obvious solution to meet such requirements is to operate the internal combustion engine with as lean a fuel-air mixture as possible, i.e., to operate the engine along the so-called lean running limit of the engine. In this operational domain, one may assume that the exhaust gas is relatively free from toxic components and that the fuel consumption will be relatively low. One of the possible parameters which characterizes the lean running limit appears to be the fluctuation of the pressure in the cylinders of an internal combustion engine.

However, when this problem is considered more carefully, it is found that the pressure in the cylinders of the internal combustion engine is determined by uncontrollable operational conditions of the internal combustion engine, for example by fluctuations of the air number and of the charge and by turbulence. When the pressure in the combustion chamber is determined from measurements of the instantaneous angular speed of the crankshaft, there are additional error-producing influences, caused, for example, by the oscillating masses of the drive means for the crankshaft, an unevenness of the road on which the vehicle travels or by some other forces acting on the engine block of the internal combustion engine.

These fluctuations are superimposed on the normal pressure curve in a cylinder of the internal combustion engine and they result in fluctuations of the angular speed of the crankshaft. These superimposed oscillations might be removed by the use of low-pass filters, but the use of such filters invites considerable problems because the internal combustion engine is to be operated in a wide rpm domain and it is very difficult to find filters which are equally suitable at both low and high rpm's (frequencies).

OBJECT AND SUMMARY OF THE INVENTION

Based on these above stated problems, it is a principal object of the invention to provide a method which permits the regulation of the internal combustion engine within a particular operational domain without incurring the above cited difficulties or disadvantages.

It is a further object of the invention to provide a method for detecting and processing the fluctuation of the mean combustion chamber pressure.

These and other objects are attained according to the invention by providing that the irregular rotation of the internal combustion engine is compared with a uniformly rotating system and that changes of phase of the crankshaft of the engine with respect to the uniformly rotating system are determined. The invention further provides that the changes of the phase angle are used as a controlled variable in a control loop for changing the fuel-air mixture of the engine. Alternatively the control loop may change the exhaust gas recycling rate. The changes in the phase angle are characteristic of fluctuations of the mean pressure in the working cycles of the engine.

It is a second principal object of the invention to provide an apparatus for carrying out the above-described method which permits a simple and reliable regulation of the engine. Thus, it is a particular object to provide an apparatus which operates reliably even when the motor vehicle is subjected to extreme demands. If possible, measuring sensors already present within the motor vehicle are to be used in the regulation. It is yet another object of the invention to provide an apparatus which is relatively inexpensive.

The second principal object of the invention is attained by providing a mechanical elastic-inertial system for determining the phase angle between the irregularly rotating crankshaft of the engine and the reference system. The elastic-inertial system has a first member rigidly coupled to the crankshaft of the engine and it also has a second member connected to the crankshaft via a torsional spring. Both members carry fiducial markers. It is further provided that the characteristic frequency of the elastic-inertial system is small compared to the frequency of fluctuations of the crankshaft of the engine.

Further objects and advantages will become apparent from the ensuing detailed specification of a preferred embodiment of the invention taken in conjunction with the drawing.

DESCRIPTION OF THE PREFERRED EMBODIMENT

The following description relates to methods and apparatuses by means of which an internal combustion engine may be operated, at least part of the time, in the operational domain adjacent to its lean running limit. The so-called lean running limit defines an operational domain in which there is a first occurrence of a retarded combustion process. Actual combustion failure, i.e. a missing engine, occurs only when the mixture is considerably leaner than it is in this domain, namely when the air number $\lambda$ is 5% to 10% larger, i.e. when the mixture is definitely lean. Within an operational domain so defined, the fuel consumption is, in general, substantially lower than within an operational domain of the engine in which its fuel-air mixture is stoichiometric, i.e. where the air number obeys $\lambda=1$. In general, when the fuel-air mixture delivered to the internal combustion engine is leaned out, the turnover of the gases in the combustion chamber is slowed and the combustion of the fuel-air mixture is displaced from the region of the top dead center of the piston toward and into the expansion stroke of the piston. The cyclic fluctuations of the combustion process and hence those of the torque increase, and if the load factor is nearly constant, the normally relatively regular fluctuations of the angular speed of the crankshaft become increasingly irregular.

Figure 1:
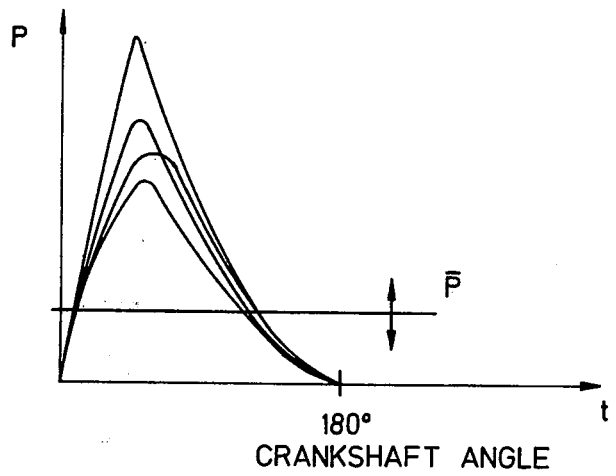
FIG. 1 is a diagram in which the pressure in a cylinder of the internal combustion engine is shown in a function of time.
Figure 2:
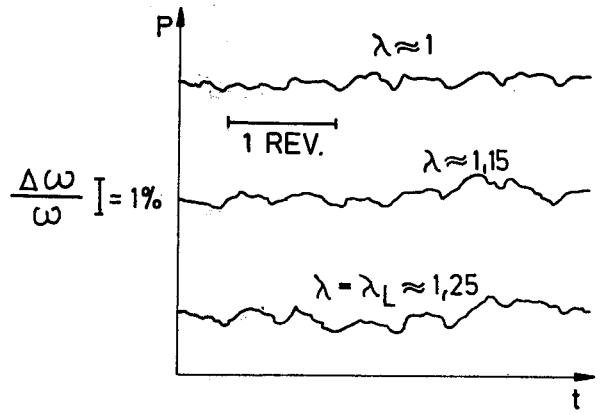
FIG. 2 is a diagram depicting the changes in the angular speed as a function of the composition of the fuel-air mixture.

Turning now to the drawings, FIG. 1 is a diagram of the pressure in a cylinder of an internal combustion engine as a function of time. It may be seen that the pressure first increases, then attains a maximum and subsequently drops abruptly. This pressure is subject to a great deal of scattering which has an effect on the angular speed of the crankshaft of the engine. The curves show that a continuous measurement of the combustion chamber pressure would not be useful for a stable control of the fuel-air mixture and hence of the operational behavior of an internal combustion engine. However, if attention is confined to the pressure within an angular crankshaft region between 0° and 180°, i.e. during a single piston stroke, and if the instantaneous values of the pressures are integrated, one obtains an average combustion chamber pressure which also varies in dependence on the composition of the fuel-air mixture. It is an object of this invention to exploit the scattering of the cyclic fluctuations of this average combustion chamber pressure within predetermined time intervals for controlling the operational behavior of the internal combustion engine. Naturally, the most precise method for measuring the average combustion chamber pressure is to dispose a pressure sensor within the combustion chamber, but such measurements are extremely expensive. It is simpler, therefore, to monitor the fluctuations of the torque at the crankshaft of the engine. It is still simpler to determine the changes in the angular speed of the engine, i.e. the changes in the time taken by the crankshaft to rotate through the angular distance between two predetermined angles. The conditions described above will now be elucidated with the aid of FIG. 2, in which the normalized change of the angular crankshaft speed is shown as a function of time and for several values of the fuel-air mixture. The top curve relates to an air number $\lambda=1$, i.e., a stoichiometric mixture; the middle curve is related to an air number $\lambda=1.15$; and the bottom curve is for an air number $\lambda=1.25$. From these curves, it may be seen that the fluctuations of the angular speed of the crankshaft increase with an increasing air number $\lambda$, i.e. with an increasingly lean mixture.

If, for example, a rigid fiducial marker is affixed to the crankshaft of the engine and if the separation of this marker on the crankshaft from a fiducial signal derived from a reference system is determined, then the change of the angular speed which results from fluctuations of the mean pressure in the combustion chambers of the engine is represented by an angle. The reference system is so constructed that it rotates at the same basic rpm of the crankshaft, but without experiencing the cyclic fluctuations which result from fluctuations of the mean combustion chamber pressure. The angle is produced by comparing the motion of the marker on the irregularly rotating crankshaft with a corresponding marker on a uniformly rotating system. Thus, the cyclic fluctuations cause a phase difference or a difference in the separation, i.e. a new relative angle between thw two markers, which may be measured, for example, after each piston stroke.

Figure 3:
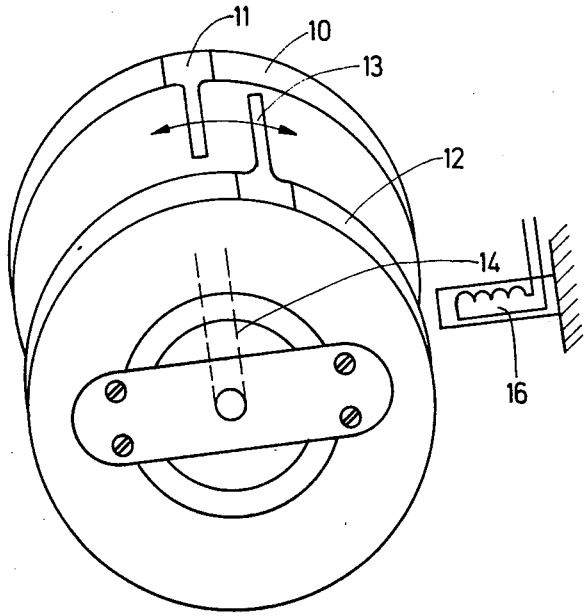
FIG. 3 is a perspective view.

FIG. 3 is a sectional diagram of a mechanical spring-inertial system, which makes it possible to obtain a signal representing an angle in the appropriate form which is characteristic of the cyclic fluctuations of the crankshaft with respect to a reference system. For this purpose, the system includes a first disc 10 with a fiducial marker 11. The first disc 10 is rigidly connected to the crankshaft of an internal combustion engine, not further shown. Located opposite the first disc 10 is a second disc 12 on which is affixed a fiducial marker 13. The two discs 10 and 12 are coupled to one another by means of a torsional spring 14. The elastic-inertial system constructed in this manner has a low natural characteristic frequency by comparison with the frequency of fluctuations of the internal combustion engine. A damper may be provided between the two discs 10 and 12.

Figure 4:
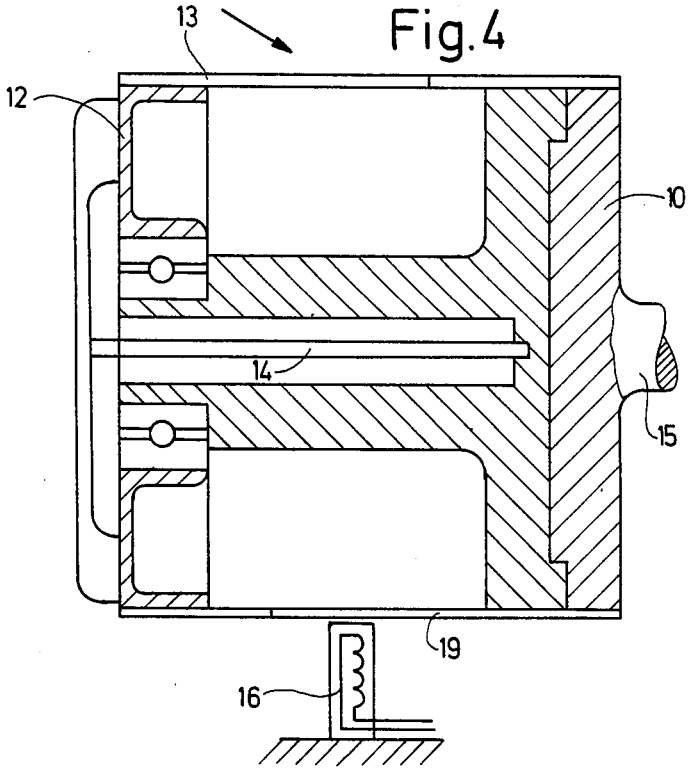
FIG. 4 is a sectional view of a signal generator for detecting the relative phase angle between the crankshaft of the engine and a rotating reference system.

FIG. 4 is a sectional view of the spring-inertial system described above in which the disc 10 is shown to be rigidly coupled to the crankshaft 15. The sectional diagram shows the two discs 10 and 12 in a relative rotational configuration in which the marker 11 of the disc 10 is exactly opposite the marker 13. (The two discs 10 and 12 are coupled to each other by the torsional spring 14.)

Located in the vicinity of the elastic-inertial system described above is an inductive transducer 16 which serves to measure the distance, i. e. the angle between the two markers 13 and 11 on the discs 12 and 10, respectively. When the acceleration of the internal combustion engine is zero, then the angle between the two markers 11 and 13 on discs 10 and 12, respectively, is constant. This angle remains constant even during a constant acceleration of the internal combustion engine because of the low characteristic frequency of the spring-inertial system. The relative angle changes only when cyclic fluctuations of the combustion chamber pressure take place in the engine, which is not shown. This relative angle is determined in the following way. The inductive transducer 16 measures the time which elapses between the passage of the markers 11 and 13, for example, after one complete piston stroke in one of the engine cylinders. When this elapsed time is multiplied by the basic rpm of the elastic-inertial system, the result is proportional to an angle. This angle is transformed into an electrical signal in a subsequent angle-to-voltage converter which will be described in detail below.

Figure 5:
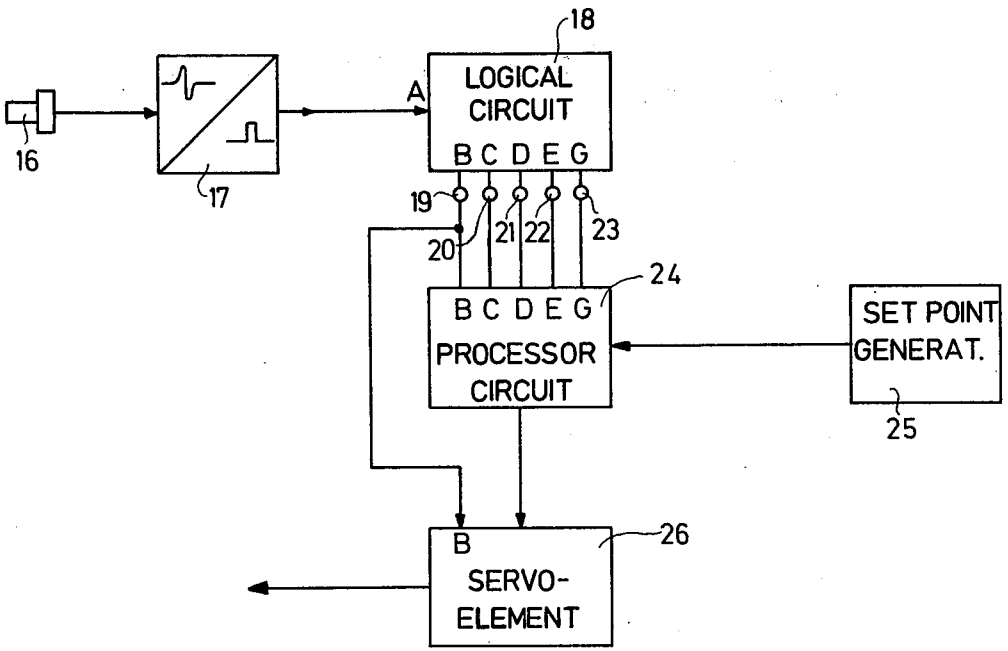
FIG. 5 is a block diagram of the electrical connections in an apparatus for changing the fuel-air composition in dependence on the phase angle.

FIG. 5 is a block diagram of an apparatus for changing the composition of the fuel-air mixture in dependence on the time difference in the passage of the markers 11 and 13, i.e. in dependence on the determined relative angle. The inductive transducer 16 is connected to a pulse shaping circuit 17 and hence to a logical control circuit 18 which has output contacts 19–23. These output contacts are connected to a processing circuit 24 which includes the above-mentioned angle-to-voltage converter as well as a comparator in which the actual value of the voltage which represents the angle is compared with the nominal or set-point value which is provided by a set-point generator 25. The output signal from the processor circuit 24 is fed to a servo member which engages a fuel injection system or another fuel preparation system of an internal combustion engine so as to change the composition of the fuel-air mixture. The output signal of the member 26 can also be used to alter the exhaust gas recycling rate of an internal combustion engine by opening or closing a valve located in an exhaust gas recycle conduit.

Figure 6:
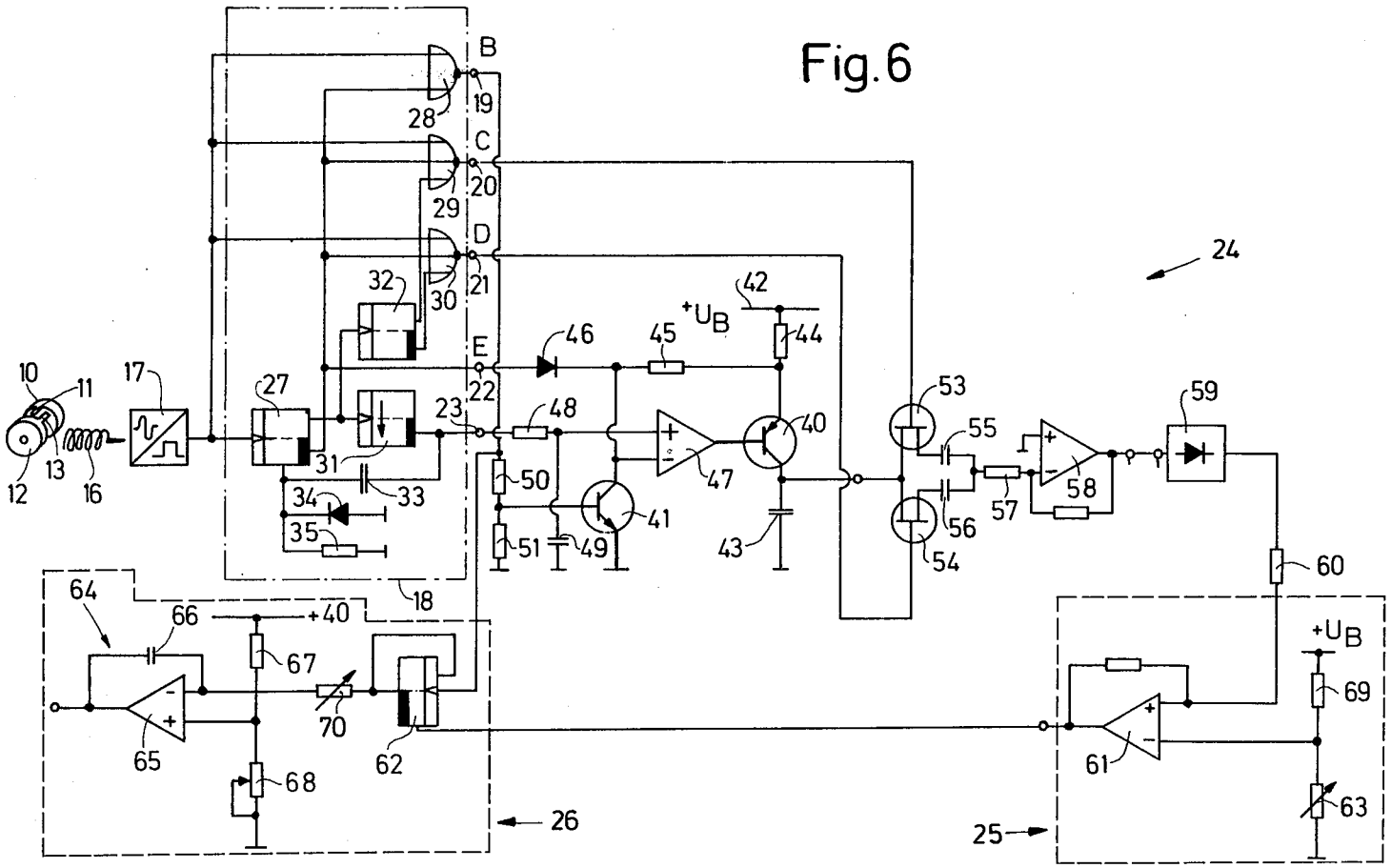
FIG. 6 is the electric circuit diagram of the apparatus according to FIG. 5.
Figure 7:
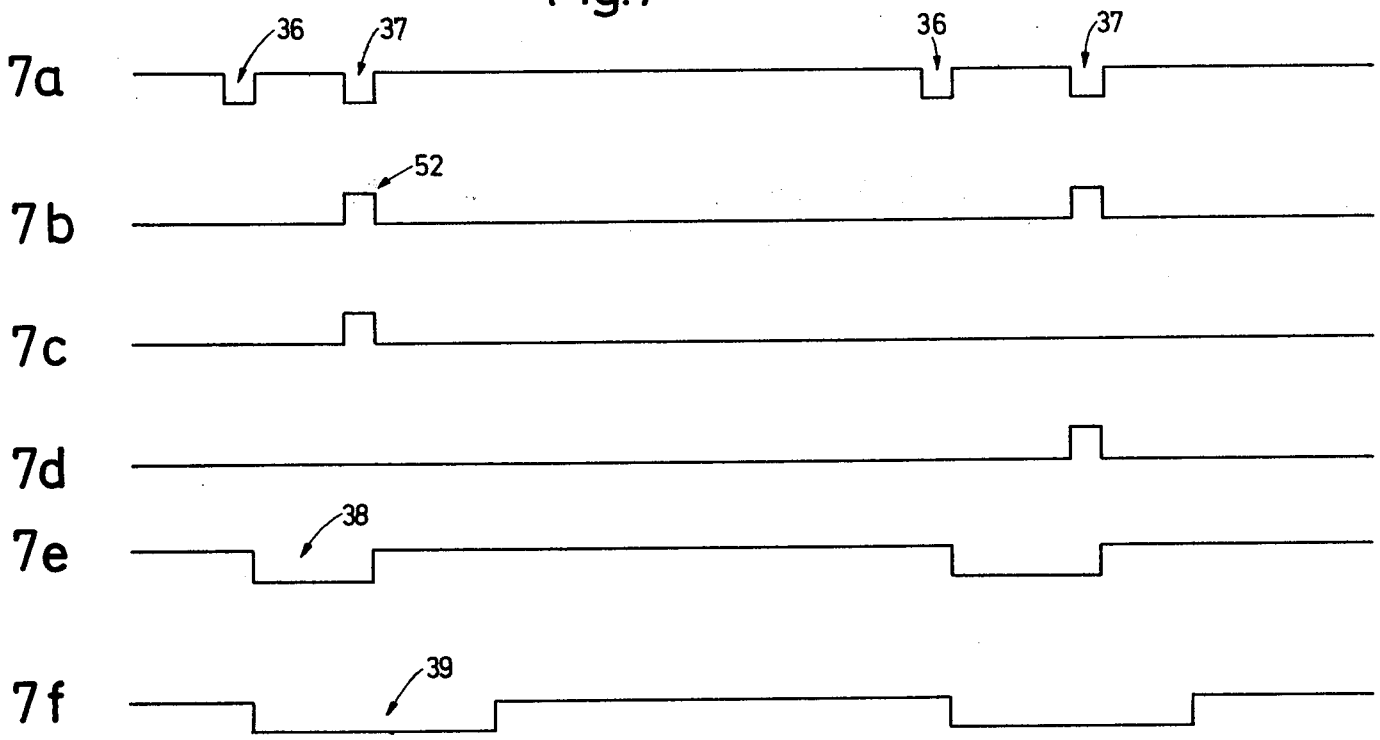
FIG. 7 is a timing diagram for showing the operation of the circuitry according to FIG. 6.

FIG. 6 is a circuit diagram of an apparatus for changing the composition of the fuel-air mixture in dependence on the determined time difference of passage of the two markers 11 and 13 on discs 10 and 12, respectively. When the markers 11 and 13 pass the inductive transducer 16, they induce therein an electric potential which the pulse shaping circuit 17 transforms into rectangular pulses of constant width. The output of the pulse shaping circuit 17 goes to the logical control circuit 18, indicated by a dash-dot border, which includes a first bistable multivibrator 27 whose clock input is connected directly to the output from the pulse shaping circuit 17 which is also connected to one input of each of three NOR gates 28, 29 and 30. Another input of each of the NOR gates 28, 29 and 30 is connected to an output of the bistable multivibrator 27. A second output of the bistable multivibrator is connected to the clock input of a monostable multivibrator 31 and also to the clock input of a second bistable multivibrator 32. A first output of the second bistable multivibrator is connected to one input of the NOR gate 30 and a second output of the bistable multivibrator 32 is connected to an input of the NOR gate 29. The output of the monostable multivibrator 31 is connected to a capacitor 33 whose other side is connected to the set input of the first bistable multivibrator 27. Also connected to the set input of the bistable multivibrator 27 is a diode 34 and a resistor 35, the other sides of which are connected to ground. The outputs of NOR gates 28, 29, 30 are connected to the output contacts 19, 20 and 21, respectively, of the control circuit 18. An output of the first bistable multivibrator 27 is connected to the output contact 22 and the output of the monostable multivibrator 31 goes to the output contact 23. The method of operation of the logical control circuit shown in FIG. 6 will be explained with the aid of the timing diagram shown in FIG. 7. FIG. *7a* shows the pulses occurring at the output of the pulse shaping circuit 17. The pulse designated with a numeral 36 shows a change of the binary signal at the output of the pulse shaping circuit 17 from "1" to "0", when the marker 11 passes the transducer 16 and the pulse designated 37 refers to the pulse which occurs during passage of the marker 13 at the inductive transducer 16. The output contact 19 carries the pulse sequence shown in FIG. *7b* since the first bistable multivibrator 27 acts as a 2:1 frequency divider so that the contact 19 has an output signal for each pulse 37.

The output contact 20 carries the signal shown in FIG. *7c* since the series connection of the first bistable multivibrator 27 and the second bistable multivibrator 32 causes a 4:1 frequency division.

The contact 21 carries the signal shown in FIG. *7d* which is also produced via a 4:1 frequency division but which is displaced with respect to the output signal according to FIG. *7c* because the NOR gate 30 is connected to another output of the second bistable multivibrator 32 than is the NOR gate 29. The output contact 22 carries the signal shown in FIG. *7e*. It may be seen from this pulse sequence that the signal at the contact 22 goes from 1 to 0 at the occurrence of a positive-going edge of the pulse 36 and that it slips back from 0 to 1 at the occurrence of the positive edge of the pulse 37. Hence the pulse 38 in FIG. *7e* has a width which is equal to the distance between the markers 11 and 13 on discs 10 and 12 respectively. FIG. *7f* shows the output signal from the monostable multivibrator 31 which occurs at the contact 23. The pulse labeled 39, which is produced by the unstable switching state of the monostable multivibrator 31 has a width which is greater than the greatest possible separation between the pulses 36 and 37 but which is smaller than the smallest possible separation between the pulses 37 and 36 in the order shown in FIG. *7a*. The signal according to FIG. *7f* can be used for synchronizing the first bistable multivibrator 27. Thus, the output signal at the contact 22 always switches from 1 to 0 whenever the pulse 36 occurs, but does not do so at the occurrence of the pulse 37. This is due to the fact that the output signal of the monostable multivibrator 31, acting via the capacitor 33, holds the first bistable multivibrator 27 in the switching state which permits a switch-over by the pulse 36 but does not permit a switch-over by the pulse 37 during the time interval in which a pulse 37 can arrive. The processor circuit 24 connected behind the control circuit 18 includes a first semiconductor switch 40 and a second semiconductor switch 41. The first switch 40 cooperates with a source of potential, not further shown, and is connected to the line 42 to serve as a controllable current source for a capacitor 43. Its collector is connected to the capacitor 43 whose other side is grounded. The emitter of the switching transistor 40 is connected to the positive supply line 42 via a resistor 44. In addition, the emitter of the transistor 40 is connected via a resistor 45 and a diode 46 to the output contact 22 of the logical control circuit 18. The junction of the resistor 45 and the diode 46 is connected to the inverting input of an operational amplifier 47 and also to the collector of a switching transistor acting as a second semiconductor switch 41. The emitter of the second switching transistor is connected to the common ground. The output of the operational amplifier is connected to the control electrode of the first switching transistor 40. The non-inverting input of the operational amplifier 47 is connected to the output contact 23 of the control circuit 18 via an RC link 48, 49. The control voltage of the second switching transistor 41 is produced by a voltage divider circuit consisting of resistors 50 and 51 in which the resistor 51 is grounded and the resistor 50 is connected to the output contacts 19 of the control circuit 18.

The method of operation of the circuit elements described above is as follows:

During the occurrence of a pulse 38 shown in FIG. *7e*, whose width is characteristic of the separation of the two markers 11 and 13, the capacitor 43 is charged through the conducting switching transistor 40. The magnitude of the charging current depends on the basic rpm of the internal combustion engine. The charging current is set by controlling the transistor 40 from the output contact 23 of the control circuit 18. The higher the voltage fed to the non-inverting input of the operational amplifier 47, the higher the rpm of the engine since the operational amplifier opens the semiconductor switch 40 to a greater or lesser degree. Thus the current flowing through the transistor 40 is proportional to the operational voltage of the supply line minus the voltage at the noninverting input of the operational amplifier. Just prior to the switch-back of the output signal at contact 22, the voltage on the capacitor 43 must be stored in a subsequent storage element. For this purpose, the increasing voltage on the capacitor 43 must be kept constant for a short period of time. This is done by using the output signal at the contact 19. When a pulse occurs at this contact, such as, for example, pulse 52 in FIG. 7*b*, the second semiconductor switch 41 becomes conducting and a negative signal is fed to the inverting input of the operational amplifier 47. Thus, the output of the amplifier 47 is a positive signal so that, for the duration of the pulse 52 in FIG. 7*b*, the switching transistor 40 is blocked. When the transistor 40 is blocked, a constant voltage is present on the capacitor 43 which may be taken over into one of the subsequent storage elements. Once the signal is transported to the storage element, the capacitor 43 is discharged when the voltage at the output contact 22 of the control circuit switches back from the value 0 to the value 1. This positive signal at the output contact 22 is fed to the inverting input of the operational amplifier 47. Hence the output of the operational amplifier 47 becomes negative and the capacitor 43 is discharged over the collector-base path of the transistor 40, operating in the inverted mode.

When the next pulse 38 of FIG. 7*e* arrives, the above-described cycle begins anew. Thus, shortly prior to the termination of pulse 38, according to FIG. 7*e*, the capacitor 43 has a potential whose fluctuations correspond to the acceleration due to the cyclic fluctuations of the mean combustion chamber pressure, i. e. of the corresponding torque changes of the crankshaft. This parameter is the actual control value, i.e. it is the controlled variable for the control loop which regulates the composition of the fuel-air mixture or the exhaust gas recycling rate in the internal combustion engine. Connected to the capacitor 43 are the switching paths of two semiconductor switches 53 and 54 in series with storage capacitors 55 and 56, respectively. The opposite electrodes of the storage capacitors 55 and 56 are joined. The control electrodes of semiconductor switches 53 and 54 are connected to the output contacts 20 and 21 of the control circuit 18, respectively. The signals occurring at the contacts 20 and 21 insure that the semiconductor switches 53 and 54 conduct alternately. During conduction, the voltages present on the capacitor 43 are alternately transferred to and stored in the storage capacitors 55 and 56. Connected to the junction of the capacitors 55 and 56 is a resistor 67 whose other end is connected to the inverting input of an operational amplifier 58. The non-inverting input of the operational amplifier 58 is connected to the common ground. The operational amplifier 58 is connected to act as an a.c. amplifier. In series with the a.c. amplifier 58 is a rectifier 59 and a resistor 60 which is connected to the non-inverting input of an operational amplifier 61 acting as a comparator. The non-inverting input of the operational amplifier 61 thus receives a voltage which acts as the actual control value, i.e. as the controlled variable for the control loop. The inverting input of the operational amplifier receives the nominal control value, i.e. the set-point value, generated, for example, by a voltage divider consisting of resistors 69 and 63. The resistor 63, which may be adjustable, can be used to change the set-point value, for example in dependence on engine parameters, such as rpm, induction tube pressure, cooling water temperature, etc.

The actual, controlled value for the control loop corresponds to the angular changes which occur when the two markers 11 and 13 are displaced angularly relative to one another. This actual value is formed by amplification of the a.c. component of the electrical signal at the junction of the storage capacitors 55 and 56 in the amplifier 58 and subsequent rectification by the rectifier 59.

The comparator 61 compares the actual value and the set-point value and the resulting signal is fed to a first input of a bistable multivibrator 62. The clock input of this bistable multivibrator 62 is connected to the output contact 19 of the control circuit 18. The output of the bistable multivibrator 62 is connected, firstly, to the second input of the bistable multivibrator 62 and, secondly, via an adjustable resistor 70 to an integral controller 64 embodied as an operational amplifier 65 with an integrating capacitor 66 connected between its output and its inverting input. The non-inverting input of the operational amplifier 65 receives a reference voltage taken from the tap of a voltage divider consisting of resistors 67 and 68.

The operation of the part of the circuit just described is as follows:

The comparator 61 compares the actual value with the set-point valve and its output is a series of short pulses when the actual value is higher than the set-point value. In the opposite case, when the actual value is smaller than the set-point value, no pulses occur at the output of the comparator 61. During the short pulses occurring at the output of the comparator 61, the bistable multivibrator 62 is switched into the state in which its output is a logical "1". On the other hand, at each clock pulse received from the output contact 19 of the control circuit 18, the bistable multivibrator 62 is switched into a state in which its output is a logical "0". If the actual value is smaller than the set-point value, the output of the comparator 61, as has been indicated above, is a constant 0. This means that no pulse reaches the set input of the bistable multivibrator 62. Thus, the output of this multivibrator 62 is 0 and the integrator 64 integrates in the positive direction, i. e. its output voltage increases and this output voltage is used to increase the actual value in the direction of the set-point value.

If, on the other hand, the actual value is greater than the set-point value, the output of the comparator 61 is a sequence of short pulses. As has been indicated above, the clock pulses bring the bistable multivibrator 62 into a position in which its output is 0. However, the pulses arriving at the set input of the bistable multivibrator 62 switch the latter over so that its output is a logical "1", which means that the output voltage of the operational amplifier 65 changes toward "0". Finally, the clock pulse occurring at contact 19 of the control circuit 18 switches the bistable multivibrator back into its state in which the output is again a logical "0".

The output signal from the integrator 64 can be used to engage, for example, the multiplying stage of a fuel injection system.

A control of this type is shown, for example, in U.S. Pat. No. 3,831,564. The output signal from integrator 64 may also be used to regulate a valve in the exhaust gas recycling conduit of an IC engine.

A control of this type is shown, for example, in U.S. Pat. No. 3,791,360.

What is claimed is:

1. A method for controlling the operation of an internal combustion engine, comprising the steps of:

coupling a reference system to a rotating member of the engine, the reference system deriving its rotation from the rotating member of the engine, said reference system having a low natural characteristic frequency in comparison with the frequency of fluctuations of the internal combustion engine;

determining the changes in the relative angular phase of the rotating member of the engine with respect to the uniformly rotating reference system in rpm synchronized time intervals which correspond to the angular region of the crankshaft rotation relates to at least one stroke of a piston of the engine;

generating an electrical control signal characteristic of said changes in the angular phase; and using said electric control signal in a control loop to change the composition of the fuel-air mixture of the engine;

whereby the operational characteristics of the engine are made dependent of the cyclic fluctuations of the combustion chamber pressure.

2. A method for controlling the operation of an internal combustion engine, comprising the steps of:

coupling a reference system to a rotating member of the engine, the reference system deriving its rotation from the rotating member of the engine, said reference system having a low natural characteristic frequency in comparison with the frequency of fluctuations of the internal combustion engine;

determining the changes in the relative angular phase of the rotating member of the engine with respect to the uniformly rotating reference system in rpm synchronized time intervals which correspond to theangular region of the crankshaft rotation related to at least one stroke of a piston of the engine;

generating an electrical control signal characteristic of said changes in the angular phase; and using said electric control signal in a control loop to alter the exhaust gas recycling rate of the engine;

whereby the operational characteristics of the engine are made dependent on the cyclic fluctuations of the combustion chamber pressure.

3. An apparatus for controlling the operation of an internal combustion engine, comprising:

(A) a first member for attachment to the crankshaft of an engine for rotation therewith, said first member being provided with a first fiducial marker;

(B) a second member, attached to said first member for substantial rotation therewith and provided with a second fiducial marker;

(C) torsion means, for providing the attachment of said second member to said first member, so that the first member can be variably positioned relative to the second member;

whereby the relative positions of said first and said second fiducial markers are used to detect combustion chamber fluctuations; and (D) electric circuit means for generating a signal related to the relative variable angular phase between said first and second members.

4. An apparatus as defined in claim 3, wherein said electric circuit means includes:

(i) inductive sensor means, located near said first and second members, for detecting the passage of said first and second fiducial markers and for generating an electrical signal;

(ii) a pulse shaping circuit for defining the waveform of the signal from said inductive sensor means;

(iii) a logical circuit, connected to receive said signal and to activate output contacts;

(iv) a processor circuit, connected to said output contacts of said logical circuit and capable of generating a signal;

(v) a servo-element, connected to receive said signals from said processor circuit;

whereby the servo-element engages operating members of the engine to control the running characteristics thereof.

5. An apparatus for controlling the operation of an internal combustion engine, comprising:

(A) a first member, for attachment to the crankshaft of the engine for rotation therewith, said first member being provided with a first fiducial marker;

(B) a second member, attached to said first member for substantial rotation therewith, said second member being provided with a second fiducial marker;

(C) torsion means, for providing the attachment of the second member to said first member, whereby the relative positions of said first and said second fiducial markers are used to detect combustion chamber fluctuations; and (D) electric circuit means for generating a signal related to the relative angular phase between the first and second members, wherein said electric circuit means includes:

(i) inductive sensor means, located near said first and second members, for detecting the passage of said first and second fiducial markers and for generating an electrical signal;

(ii) a pulse shaping circuit for defining the waveform of the signal from said inductive sensor means;

(iii) a logical circuit, connected to receive said signal and to activate output contacts;

(iv) a processor circuit, connected to said output contacts of said logical circuit and capable of generating a signal;

(v) a servo-element, connected to receive said signals from said processor circuit, whereby the servo-element engages operating members of the engine to control the running characteristics thereof; wherein said processor circuit includes:

a first semiconductor switch, controlled by said logical circuit;

a capacitor, connected to said first semi-conductor switch to be charged thereby;

two data storage elements, connected for storage of signals from said capacitor;

an a.c. amplifier connected to said data storage elements for amplifying the difference of signals in said storage elements;

a rectifier for rectifying the output signal from said a.c. amplifier; and a comparator circuit, for comparing the rectified output from said a.c. amplifier with a set-point voltage and for generating an output signal, wherein the output signal from said comparator circuit is fed to said servo-element which has integral control behavior.

6. An apparatus according to claim 5, wherein said logical circuit includes means for controlling said first semiconductor switch in r.p.m.-dependent manner.

7. An apparatus according to claim 6, wherein said processor circuit includes a second semiconductor switch, controlled by said logical circuit, for switching said first semiconductor switch.

8. An apparatus according to claim 7, wherein said logical circuit includes:

a first bistable multivibrator;

logical gate circuits connected to said first bistable multivibrator;

a monostable multivibrator connected to said logical gate circuits for forming therewith a 4:1 frequency divider.

9. An apparatus according to claim 8, wherein said logical circuit further includes:

a second bistable multivibrator, whose output is connected to said first semiconductor switch for effecting r.p.m.-dependent control thereof.

10. An apparatus according to claim 9, wherein said processor circuit further includes:

a diode connected to the output from said first bistable multivibrator; and an operational amplifier, whose input is connected to said diode and whose output controls said first semiconductor switch; whereby said first bistable multivibrator serves to switch said first semiconductor switch to the state in which said capacitor is discharged.

* * * * *